United States Patent [19]

Slocum et al.

[11] 4,437,274

[45] Mar. 20, 1984

[54] BUILDING PANEL

[75] Inventors: Donald H. Slocum, Villa Park; Albert W. Schairbaum, St. Charles; William M. Curtis, Genoa, all of Ill.

[73] Assignee: Masonite Corporation, Chicago, Ill.

[21] Appl. No.: 374,166

[22] Filed: May 3, 1982

[51] Int. Cl.[3] ..... E04D 1/00

[52] U.S. Cl. ..... 52/105; 52/553; 52/554; 52/559

[58] Field of Search ..... 52/533, 553, 534, 541, 52/557, 558, 559, 560, 105, 554, 555

[56] References Cited

U.S. PATENT DOCUMENTS

| | | | |
|---|---|---|---|
| Re. 24,246 | 12/1956 | Fink | 52/553 |
| 1,188,472 | 6/1916 | Morton | 52/533 |
| 1,417,641 | 5/1922 | Stuffings | 52/105 |
| 3,407,556 | 10/1968 | Liebrook | 52/559 |
| 3,796,586 | 3/1974 | Hanlon et al. | 52/313 |
| 3,848,384 | 11/1974 | Eaton et al. | 52/420 |
| 3,868,300 | 2/1975 | Wheeler | 162/124 |
| 4,279,106 | 7/1981 | Gleason et al. | 52/100 |

FOREIGN PATENT DOCUMENTS

| | | | |
|---|---|---|---|
| 473676 | 5/1951 | Canada | 52/553 |

*Primary Examiner*—Henry E. Raduazo
*Attorney, Agent, or Firm*—Mason, Kolehmainen, Rathburn & Wyss

[57] ABSTRACT

A building panel having inner and outer faces outlined by opposite ends and an upper and lower edges with opposite ends of the panel adapted to closely face the ends of adjacent panels in the same course. The outer face of the panel includes a lower portion of substantially greater surface area adapted for exposure and an upper portion of relatively smaller surface area adapted to underlie a lower portion of the back face of one or more panels laid up in the next higher course. At least one of the opposite ends of the panel is formed with a spacer projection adjacent the smaller upper portion thereof extending outwardly to provide an expansion space between a lower portion of said one end and an end of an adjacent panel positioned in the same course or row. The provision of a spacer eliminates the need for an installer to attempt to provide for adequate expansion space between panel ends when installing the panels and automatically insures that an expansion space of the desired width is present and not forgotten during installation of the panels.

11 Claims, 24 Drawing Figures

BUILDING PANEL

BACKGROUND OF THE INVENTION

1. Field of the Invention

The present invention relates to man-made building panels formed of wood composite materials and more particularly, relates to building panels which are suitable for use as exterior roofing or siding on outside building roof and/or wall surfaces. Each panel is provided with an outer weather surface shaped with a design and grooves which resemble a plurality of shingles or shakes on a roof or wall surface.

2. Description of the Prior Art

A variety of building wall and roofing panels have been promoted for use in lieu of conventional shingles or shakes which are small in size and require relatively large amounts of installation labor. U.S Pat. No. 3,796,586 discloses a deep embossed, shingle lap siding formed of pressed wood fibers and U.S. Pat. No. 3,868,300 discloses a composite wall panel laminate having deep indentations in an outer face thereof formed with a tough, outer fibrous skin and a core of relatively course, less dense fibrous material. U.S. Pat. No. 4,279,106 is directed towards a roofing panel with a thin outer shell of hard plastic material formed with a cavity on the underside which is filled with polyurethane foam.

OBJECTS OF THE INVENTION

It is an object of the present invention to provide a new and improved, exterior building panel for installation on sloped roofs and vertical walls.

More particularly, it is desirable to provide a building panel of the character described formed of wood composite material which can be installed with a minimal amount of installation labor and which is aesthetically pleasing to the eye and which resembles a plurality of individual shingles or shakes on a roof or sidewall.

Yet another object of the present invention is to provide a new and improved building panel of the character described which is resistant to wind and water, relatively light in weight, easy to handle and which requires a minimum number of individual panels for a given area or "square" of wall or roofing surface area covered.

Still another object of the present invention is to provide a new and improved building panel of the character described which is essentially selfaligning, easy and quick to install, and which provides a means for accommodating expansion of the panels.

Yet another object of the present invention is to provide a new and improved building panel of the character described which when laid in place minimizes the visibility of joints between the panels and which minimizes the perceptability of a repeating pattern on a wall or roof structure on which the panels are installed.

Another object of the invention is to provide a new and improved building panel of the character described having a spacer for automatically establishing an expansion space between the ends of panels as they are laid up end to end in a common row or course.

BRIEF SUMMARY OF THE INVENTION

The foregoing and other objects and advantages of the present invention are accomplished in a new and improved, rectangular building panel formed of wood composite material and having inner and outer faces outlined by opposite ends and upper and lower edges.

The panels are adapted to be laid end to end in courses or rows and in overlapping relation from row to row. The outer face of a panel includes a lower portion of substantially greater surface area which is adapted for exposure to the weather and which is shaped or embossed to resemble a plurality of individual shingles or shakes laid side by side with grooves therebetween appearing to the eye as the usual joints between adjacent separate shingle elements. The outer face of the panel also includes a narrow strip or upper portion of relatively smaller surface area which is adapted to underlie a lower portion of the back face of one or more panels laid up in the next higher row or course in overlapping relation therewith forming a head lap. At least one of the opposite ends of the panel is formed with a spacer projection adjacent the smaller area upper portion thereof and the spacer projects outwardly to provide an expansion space between a lower portion of said one end and the end of a next adjacent panel which is positioned end to end in the same row or course. When a prior art panel on a roof or wall is exposed to the weather it may expand relative to an adjacent panel and if not relieved, buckling or warping of the panels may occur. The spacer of the present invention provides an expansion space for relieving the forces of expansion and the lower portion of the panels can laterally expand into the expansion space that is assured by the spacer so that warping or buckling of the building panels is eliminated. The end spacer eliminates the need for an installer to anticipate how much space to provide between panel ends during installation and insures that adequate expansion space is always provided for and not forgotten during installation. The expansion space between adjacent panels formed below the spacer is similar in appearance to grooves formed in each panel between the embossed shingle-like elements or shakes thereof.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENTS

Figures 1, 2:
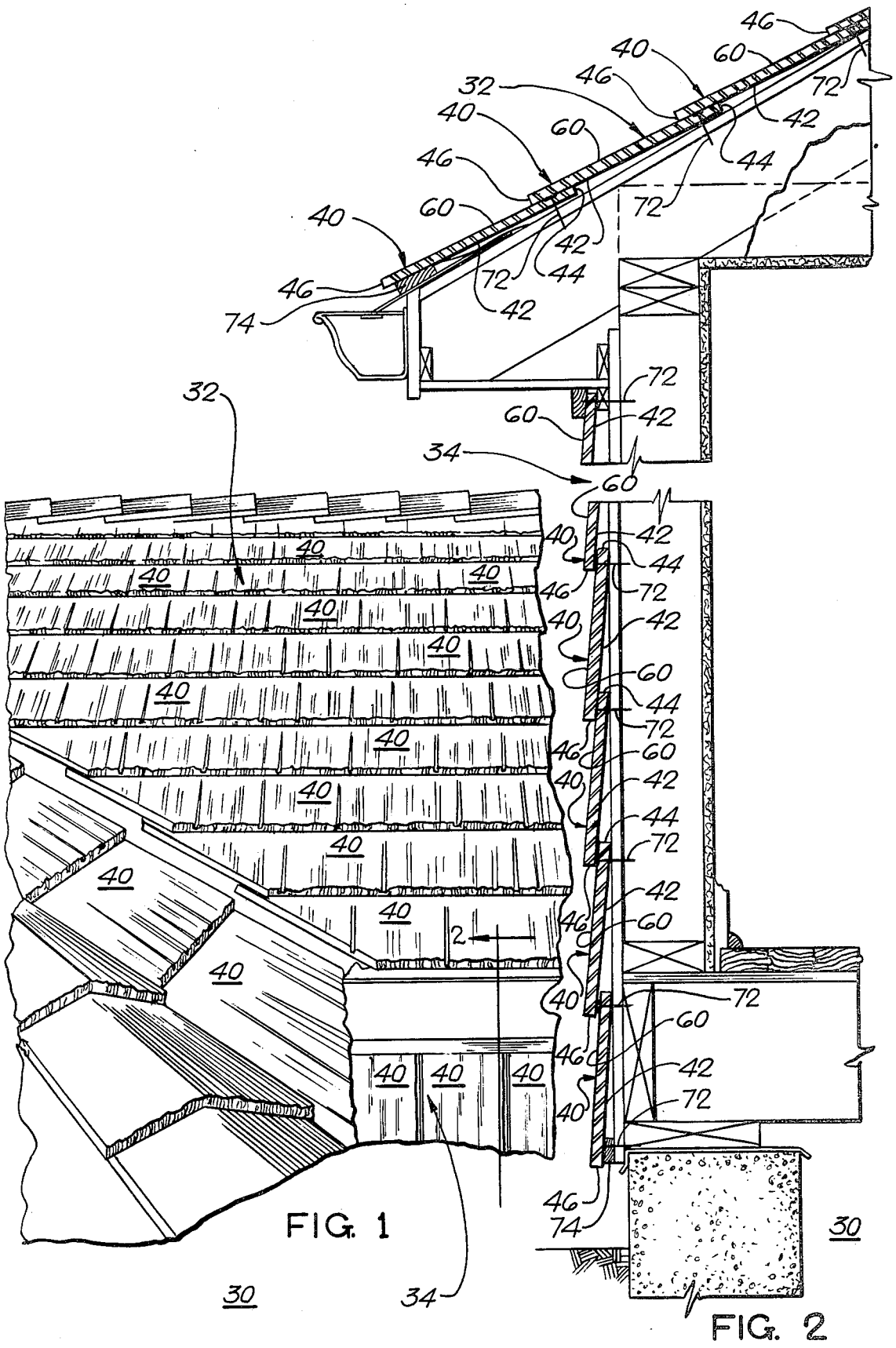
FIG. 1 is a fragmentary elevational view of a typical building structure utilizing building panels in accordance with the present invention laid up in parallel courses or rows in overlapping relation.
FIG. 2 is a vertical cross-sectional view taken substantially along lines 2—2 of FIG. 1.
Figure 3:
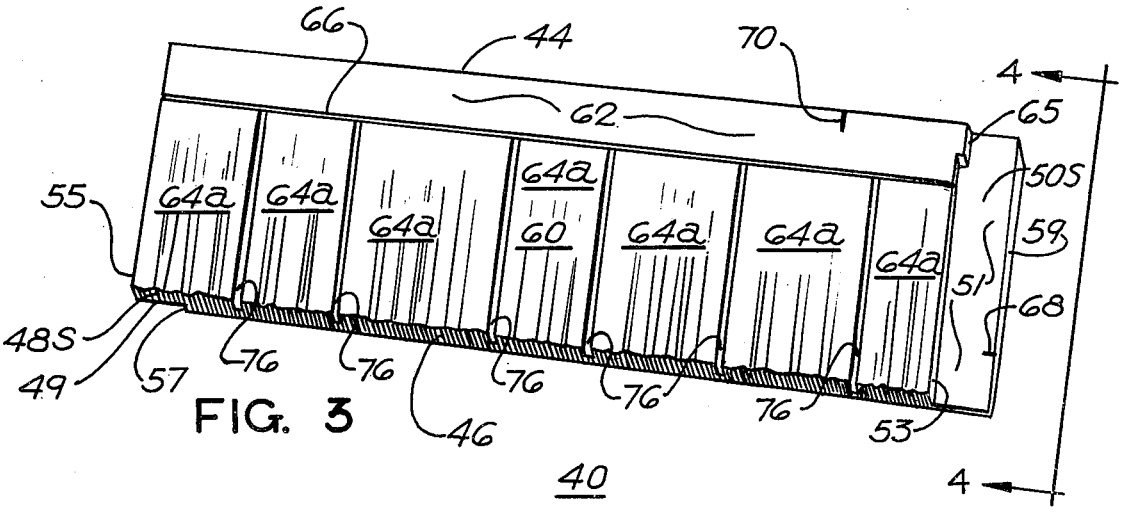
FIG. 3 is a perspective view of one embodiment of a new and improved building panel in accordance with the features of the present invention showing an outer face thereof and a lower butt edge.
Figure 4:
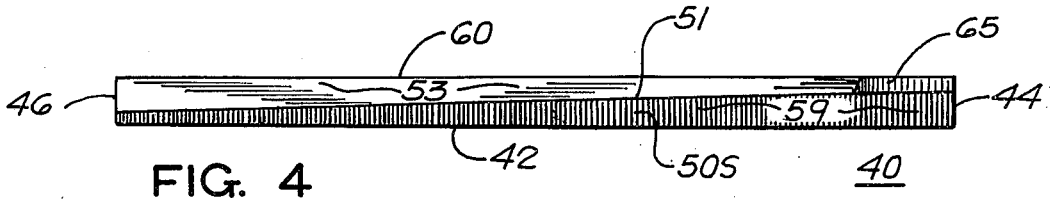
FIG. 4 is an end elevational view of the panel of FIG. 3 looking in the direction of arrows 4—4 of FIG. 3.
Figure 5:
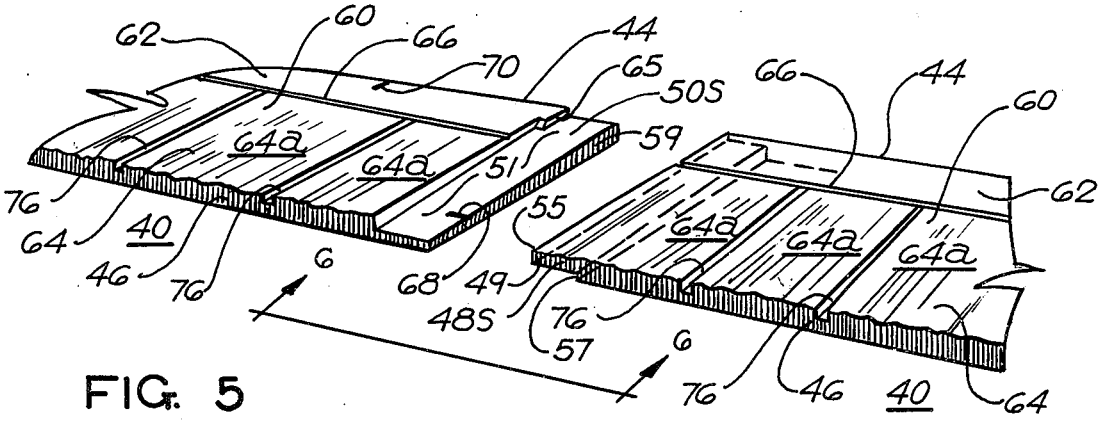
FIG. 5 is fragmentary elevational view in perspective illustrating adjacent ends of a pair of building panels ready to be laid up end to end in a common course or row.

Referring now more particularly to the drawings, in FIGS. 1 and 2 is illustrated a building 30 of a general or conventional type employing a sloped roof structure 32 and vertical side walls 34. The roof and walls are covered with an outer or weather surface formed by a plurality of new and improved building panels 40 which are laid up in end-to-end relation in horizontal courses or rows. The panels in each succeeding higher course overlap an upper portion of the adjacent lower course or row as best shown in FIG. 2.

Each building panel 40 is formed of wood composite material such as flakeboard, chipboard particle board, plywood or hardboard etc. of a substantially uniform thickness and is of a rectangular shape as shown in FIGS. 3, 7, 11, 15, 19 and 21. The panels include a relatively flat or planar back surface 42 bounded by an elongated upper edge or head 44 and a generally parallel, lower or butt edge 46 exposed to the weather. Each panel is formed with an outer or weather face 60 which is generally parallel to the back face except for the minor variations in the thickness because of shaping or embossing, at the grooves as will be described hereinafter, and at opposite end segments in the panel embodiments of FIGS. 3, 7, 11 and 15. The outer surface 60 includes a flat, smooth narrow strip or head lap portion 62 along the upper edge and the area of this strip comprises only a fractional or minor portion of the total or overall surface area of the whole building panel. The narrow head lap surface along the upper edge is adapted to underlie a narrow strip of back face along a lower portion of each succeeding panel or panels as they are laid up in place in a next adjacent upper row or course (as shown in FIG. 2). When laid up in place as shown, the narrow overlapping or confronting portions of the panels form a substantially water tight head lap between successive courses or rows of panels on a wall or roof.

The outer weather face of each panel includes a relatively large, lower surface portion 64 lying below the narrow upper head lap 62 and delineated therefrom by a thin, marker line or shallow groove 66 parallel of and spaced between the upper edge 44 and the lower, exposed butt edge 46. The shallow groove or guide line 66 provides guidance for aid in aligning subsequent rows or courses of panels on a building wall or roof surface. The panels 40 are provided with a course alignment end mark or short line 68, normally located at the right hand end. These course alignment marks are aligned with the upper edges 44 of panels in the next lower course or row as a roofing or siding job proceeds.

In accordance with the present invention the weather or exposed outer face 64 of the outer surface 60 is shaped, preferably by deep embossing to resemble closely in appearance, a plurality of individual shingle or shake elements 64a of random width and order, laid up in side by side relation in a common row or course as illustrated. Each shingle element terminates along a lower butt edge coincident with the edge of the whole building panel and between each pair of adjacent individual shingle elements embossed in the outer surface 64, there is provided a tapered groove or channel 76 which is dimensioned to taper from a shallow or minimum depth at the upper end adjacent the nailing guide groove or line 66 to a greater or maximum groove depth adjacent the lower or butt edge 46 of the building panel. Each groove breaks out or becomes substantially even with the outer surface of the adjacent pair of embossed shingle elements 64a on each side just before reaching the level of the nailing guide line.

The tapered grooves provide deep relief at the lower or butt edge of the panels resulting in an overall appearance remarkably indistinguishable from that of a plurality of cedar shakes or shingles on a wall or roof surface. Along the relatively thick, butt edge 46 of each panel, the grooves 76 between each pair of adjacent embossed shingle elements may reach a maximum depth, and preferably this depth is less than the nominal thickness of the panels overall.

The tapered, deepening grooves form a thick shadow appearance which truly and accurately visually resembles a building surfaced with individual shingles or cedar shakes. Because the grooves taper to a minimum depth and break out at the upper end thereof adjacent the nail guide line before reaching the head lap strip area, there is little chance that wind driven water will be forced under the head lap between adjacent courses of panels. Instead, any water will tend to spill out from the sides of the grooves at the shallow upper end and then run back down the outer faces of the adjacent shingle elements on either side of the groove. The unique grooves 76 also provide another enhancing feature in that the building panel 40 is dimensioned to retain full nominal thickness uninterrupted for the entire length thereof above the nailing guide grooves 66 and in this area 62, fastening attachment to a building wall or roof is accomplished along the strongest portion of each panel. The panels 40 are thus strong where needed and are not subject to peel-up or fish mouthing which is a problem with many shingles and roofing materials.

Figure 24:
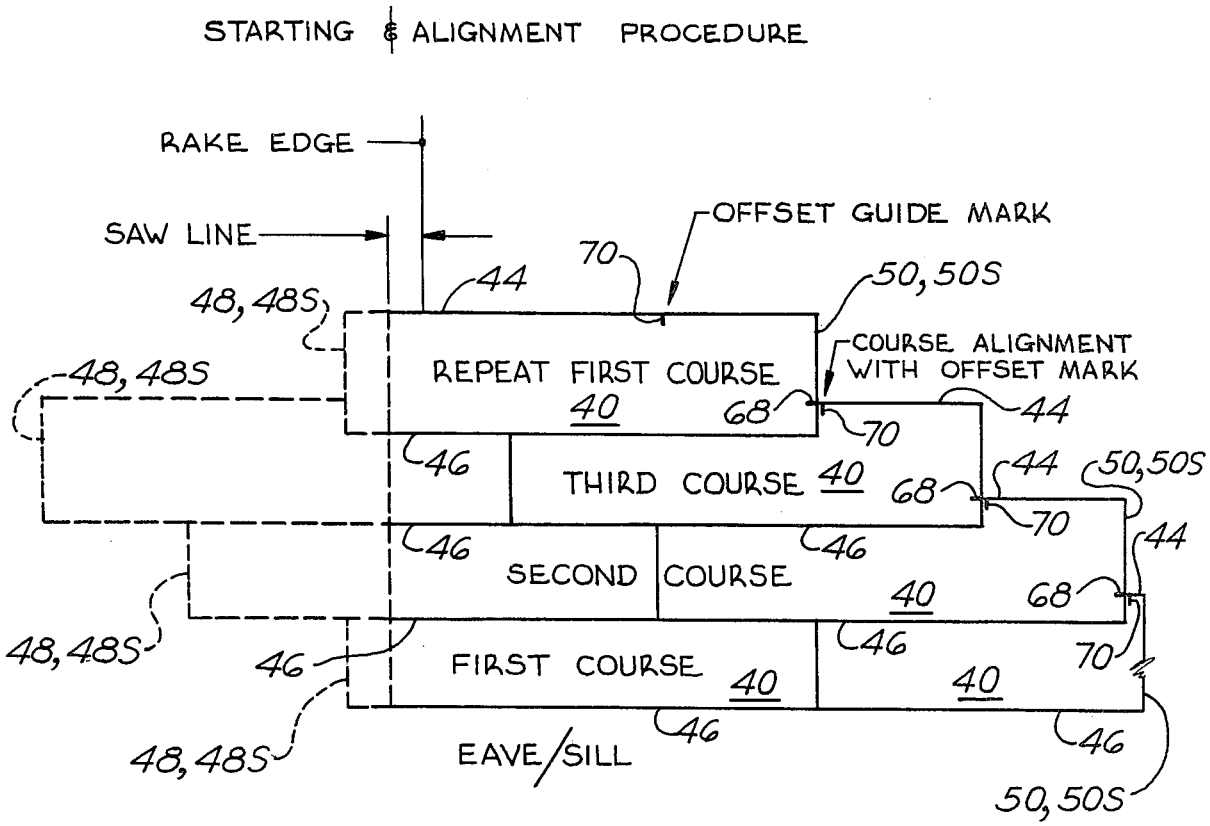
FIG. 24 is a graphic representation of a starting and alignment procedure utilized when installing building panels in accordance with the features of the present invention on a roof or building wall structure.

Each panel 40 also includes a course offset guide mark 70 formed on the outer weather face 60 and positioned in the upper head lap or strip 52 adjacent the upper edge 44. The guide marks 70 are preferably located at a distance approximately ⅓ of the total length of a panel along the upper edge inwardly from the right hand end. As illustrated in FIG. 24, the course offset guide mark on the upper edges of the panels laid in the first course are used for aligning the right hand ends of the panels in the second course. Similarly offset guide marks in the panels of the second course are used for aligning the right hand ends of the panels in the third course.

When the course offset guide marks 70 are spaced approximately ⅓ of the total length of the panels inwardly from the one end thereof, the course orientation of the panels repeats itself every third course or row that is applied on a wall or roof structure. The positioning of the course offset guide marks on a panel can be changed to a different end spacing, for example, a random spacing basis, if desired, but at somewhat increased production expense. If this is done there will be little chance of any periodic repetition of succeeding courses and a truly random pattern will result. However, it has been established that a repeat of course orientation every third course or row is almost imperceptible to the eye and provides a truly aesthetic as well as an economical weather covering for a building.

Building panels 40 of FIGS. 3, 7, 10 and 15 include ship-lap type overlapping end segments 48S at one end (lefthand end) adapted to overlay an underlying end segment 50S on the opposite (righthand end) of a next adjacent panel 40 in the same course or row to form an overlapping ship-lap type joint therewith as best shown in the righthand portion of FIGS. 6, 10, 14 and 18. The overlapping end segments 48S extend between the upper and lower edges 44 and 46 of the panels 40 and are provided with a flat or substantially planar underside 49 designed to overlap an upper side or surface 51 in a close fitting relationship when the panels are laid end to end forming ship-lap type joints therebetween.

As best shown in FIGS. 4, 8, 12 and 16, the surfaces 49 and 51 are sloped or tapered from a minimum amount of depth or spacing at the upper edges 44 of the panels down from the outer face 60 to a greater or maximum amount of spacing or depth at the lower edges 46. Because of this taper, when the panels are laid up in end to end relation as illustrated in FIGS. 5, 6, 9, 10, 13, 14, 17 and 18, grooves or open spaces 54 are formed between directly facing inner end faces 53 above the underlying end segment 50S and an outer end face 55 of the overlapping end segment 48S of an adjacent panel. The expansion spaces 54 appear similar to the tapering grooves 76 between adjacent shingle surface elements 64a in the body of the panel.

The overlapping end segments 48S also include an inner end surface 57 parallel to the upper outer end surface 55 and normal to the underside 49. Similarly, the underlying end segments 50S at the opposite or righthand end of the panel include outer end faces 59 which are parallel with the faces 53 and normal to the sloped outer surface 51. When the panels 40 are laid up end to end in the single row or course as shown in detail in FIGS. 6, 10, 14 and 18, the underside 49 of the overlapping end segment 40S is in contact against the outer side 51 of the underlying end segment 50S of an adjacent panel and this tight planar contact between these surfaces provides a water tight, ship-lap type overlapping joint with a tapered groove or expansion space 54 formed between adjacent facing surfaces 53 and 55.

In accordance with the present invention, the panels 40 are provided with spacer elements 65 which project laterally outwardly from an adjacent end face to establish and maintain the expansion space 54 at a predetermined width when a pair of panels are laid up end to end in a course or row. The spacer projection is positioned adjacent the upper edge 44 of the panel and does not extend or project downwardly below the head lap strip 62 or nail guide line mark 66. The panels are secured to the roof or wall structure by nails or fasteners positioned at intervals along the upper edge in the narrow head top portion 62. Accordingly the spacers 65, in addition to being shielded from direct exposure to the weather by the overlapping panels thereabove, are relatively fixed in position by the nails and consequently have a minimal tendency to expand in any appreciable amount in a lateral direction. Outer edge faces of the spacers are in direct abutting contact with the adjacent end surface of an adjacent panel and because the spacers are relatively small in size there is little likelihood of objectionable buckling or warping between a spacer and the end of a panel in contact therewith. When the panels are installed end to end in each course or row, the end of a panel is butted against the outer end of the spacer 65 of another panel and this establishes automatically the desired width of expansion space 54 without requiring any judgment or anticipation by the installer. Furthermore, the spacer prevents the possibility that an installer will forget about providing an expansion space altogether at some or all of the joints between panel ends during installation.

The spacers are dimensioned to have a width or extend laterally outward a distance which is substantially the same as the width of the tapered grooves 76. Accordingly the gaps or spaces 54 between adjacent surfaces 53 and 55 is established to be approximately equal to the width of the tapered grooves. The space thus formed between the end surfaces 53 and 55 permits free lateral expansion and contraction of a lower portion of the body of panels 40 and the expansion spaces 54 are automatically established during installation of the panels end to end by the end spacers 65 which are butted tightly against the adjacent panel end. The gaps or expansion spaces 54 closely match in appearance the tapered grooves 76 and the likelihood of curling or buckling caused by expansion of the exposed portion of the panels is minimized or eliminated completely by incorporation of the spacer projections 65 in the design.

Figure 6:
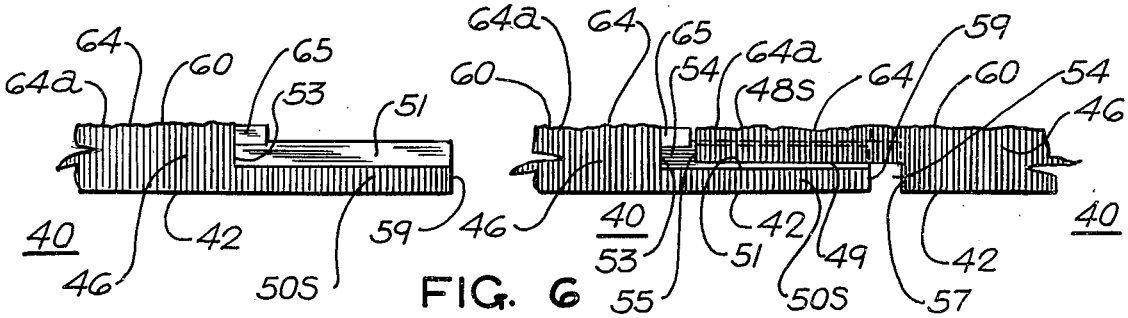
FIG. 6 is a lower edge elevational view of the panels looking in the direction of arrows 6—6 of FIG. 5 with the portion on the left illustrating a lefthand panel by itself and the portion on the right illustrating a pair of panels laid up in end to end relation with an expansion space formed at a joint between the panels as provided by the spacer on the left hand panel.
Figure 7:
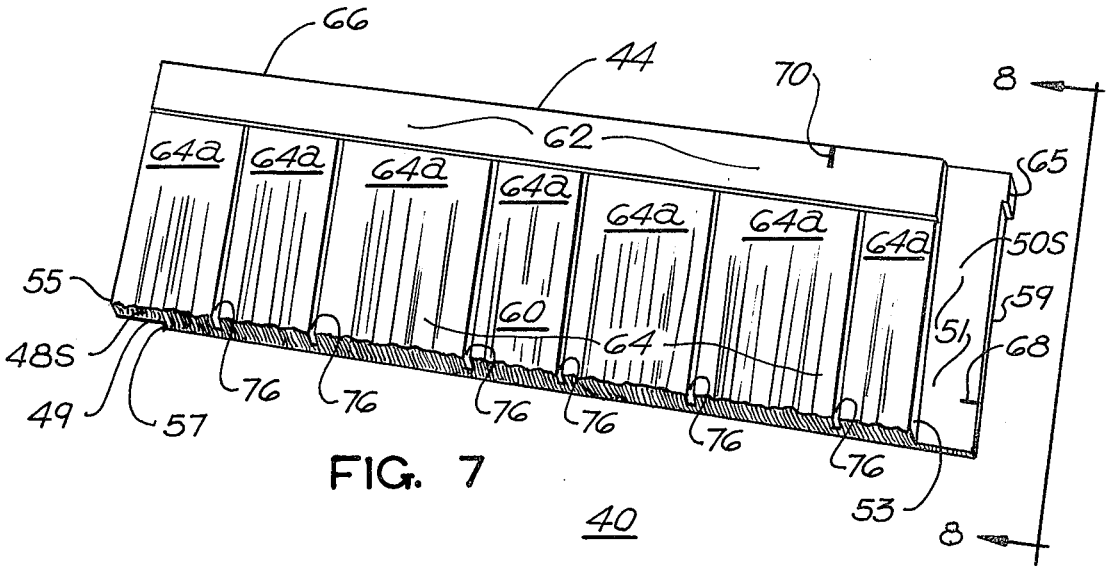
FIG. 7 is a perspective view of another embodiment of a new and improved building panel in accordance with the features of the present invention showing an outer face thereof and a lower butt edge.
Figure 8:
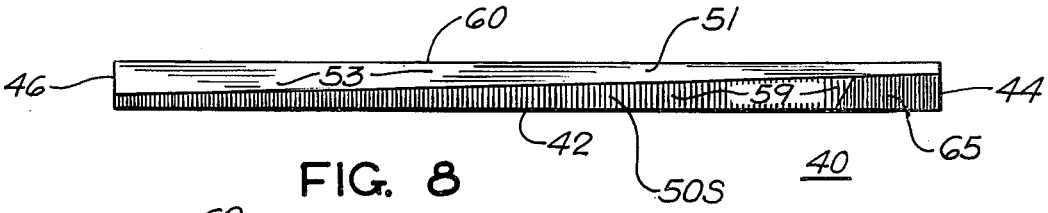
FIG. 8 is an end elevational view of the panel of FIG. 7 looking in the direction of arrows 8—8 of FIG. 7.
Figure 9:
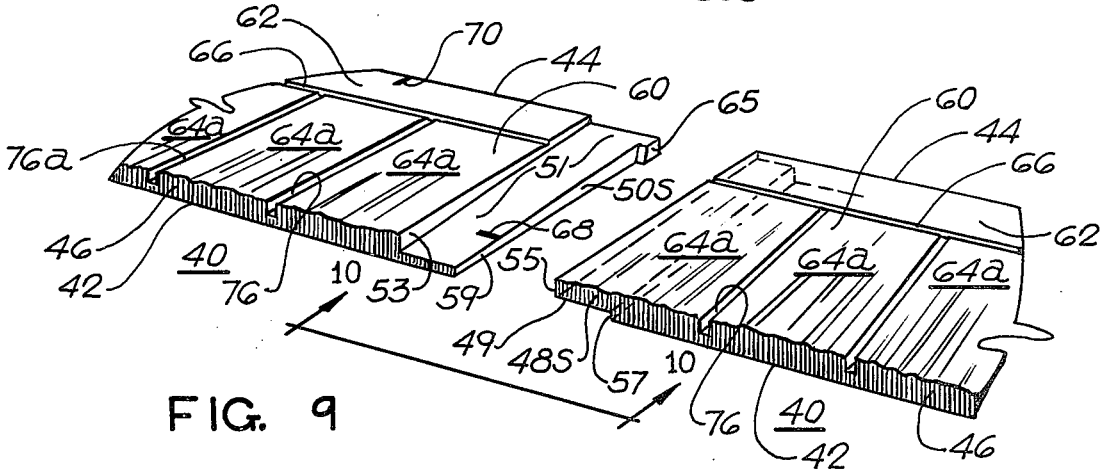
FIG. 9 is fragmentary elevational view in perspective illustrating adjacent ends of a pair of building panels ready to be laid up end to end in a common course or row.
Figure 10:
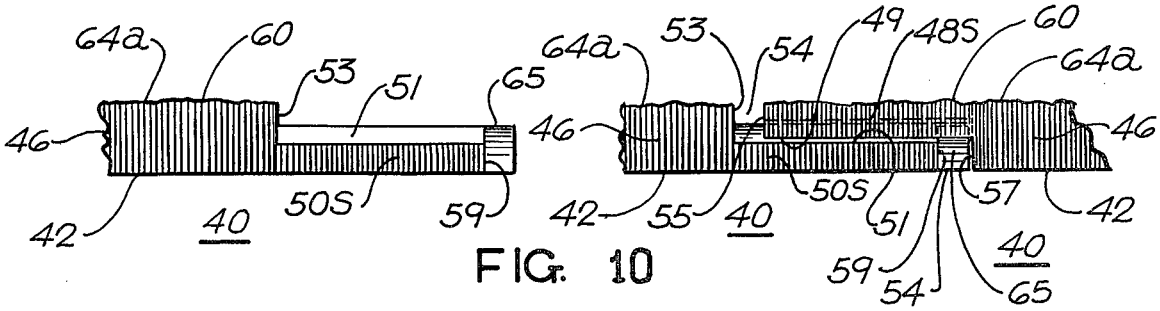
FIG. 10 is a lower edge elevational view of the panels looking in the direction of arrows 10—10 of FIG. 9 with the portion on the left illustrating a lefthand panel by itself and the portion on the right illustrating a pair of panels laid up in end to end relation with an expansion space formed at a joint between the panels as provided by the spacer on the left hand panel.
Figure 11:
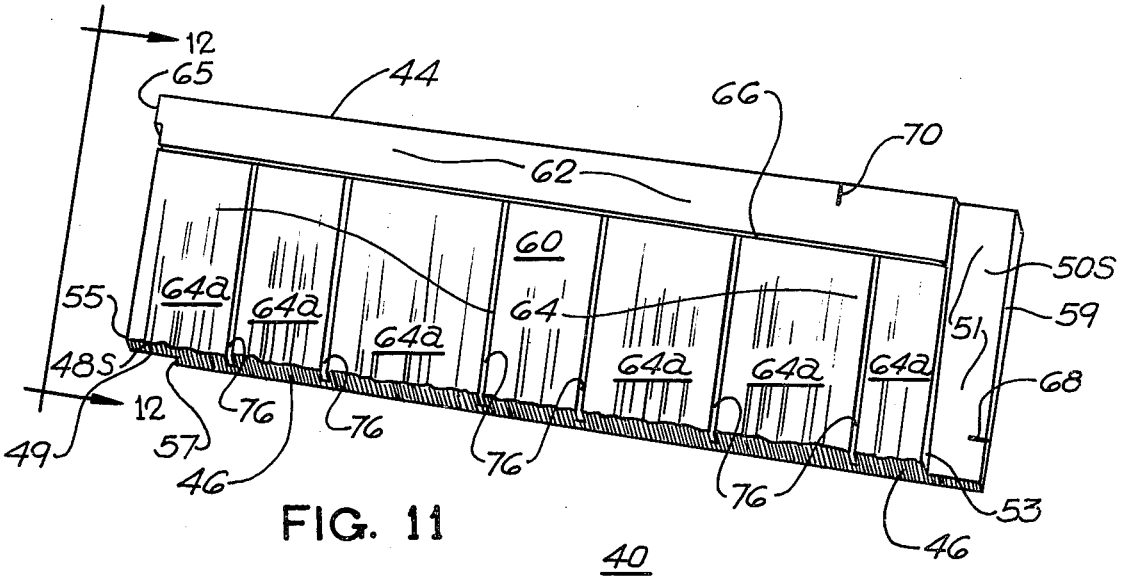
FIG. 11 is a perspective view of yet another embodiment of a new and improved building panel in accordance with the features of the present invention showing an outer face thereof and a lower butt edge.
Figure 12:
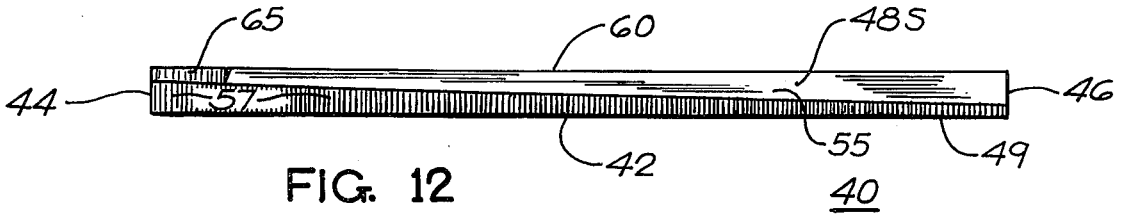
FIG. 12 is an end elevational view of the panel of FIG. 11 looking in the direction of arrows 12—12 of FIG. 11.
Figure 13:
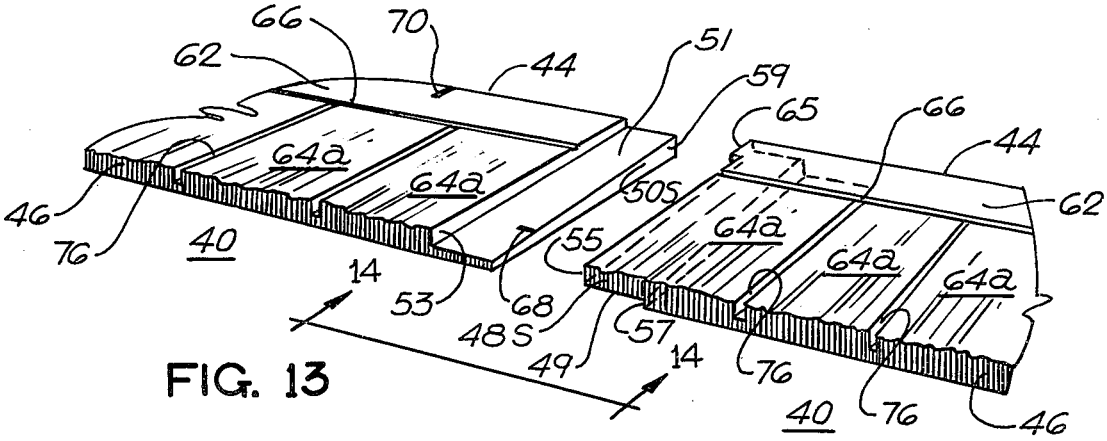
FIG. 13 is fragmentary elevational view in perspective illustrating adjacent ends of a pair of building panels ready to be laid up end to end in a common course or row.
Figure 14:
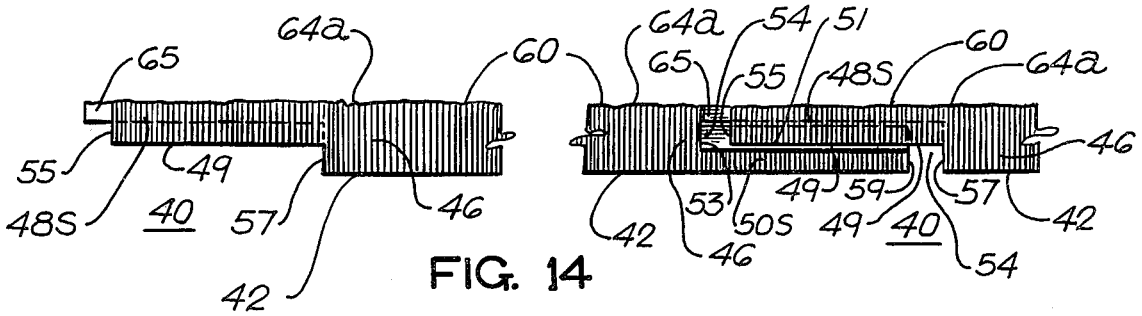
FIG. 14 is a lower edge elevational view of the panels looking in the direction of arrows 14—14 of FIG. 13 with the portion on the left illustrating a righthand panel by itself and the portion on the right illustrating a pair of panels laid up in end to end relation with an expansion space formed at a joint between the panels as provided by the spacer on the left hand panel.
Figure 15:
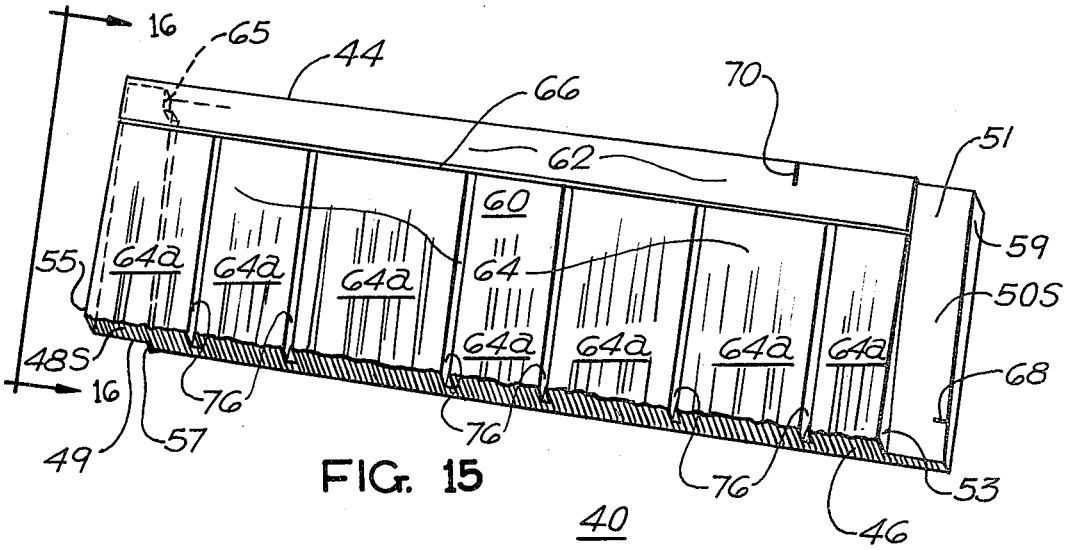
FIG. 15 is a perspective view of still another embodiment of a new and improved building panel in accordance with the features of the present invention showing an outer face thereof and a lower butt edge.
Figure 16:
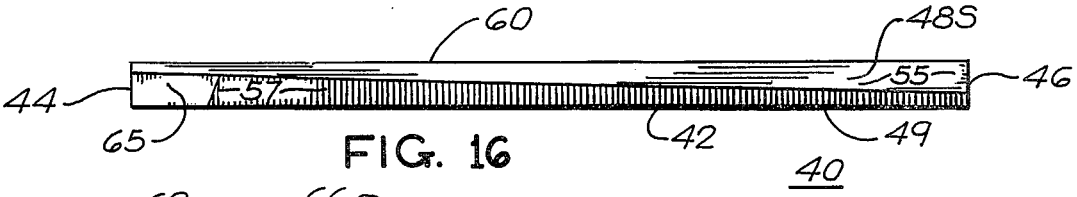
FIG. 16 is an end elevational view of the panel of FIG. 15 looking in the direction of arrows 16—16 of FIG. 15.
Figure 17:
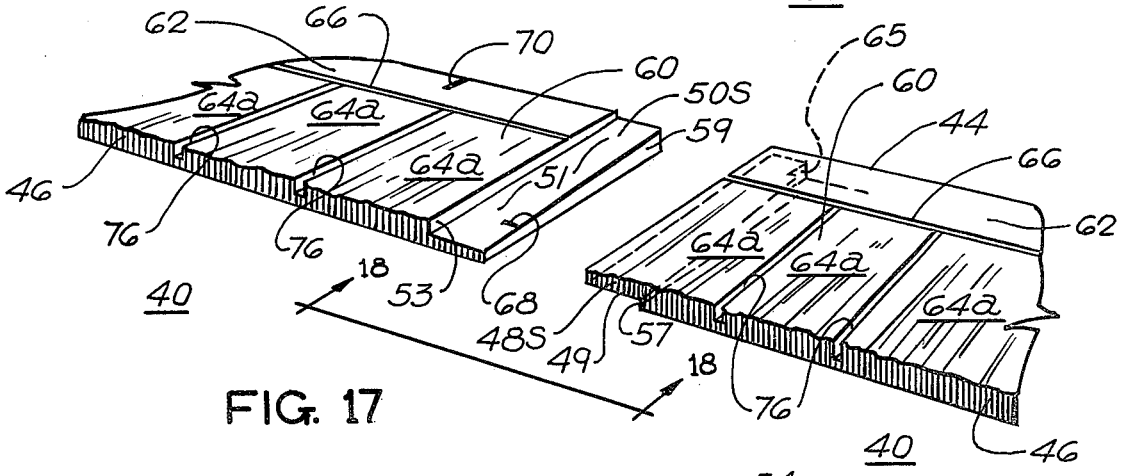
FIG. 17 is fragmentary elevational view in perspective illustrating adjacent ends of a pair of building panels ready to be laid up end to end in a common course or row.
Figure 18:
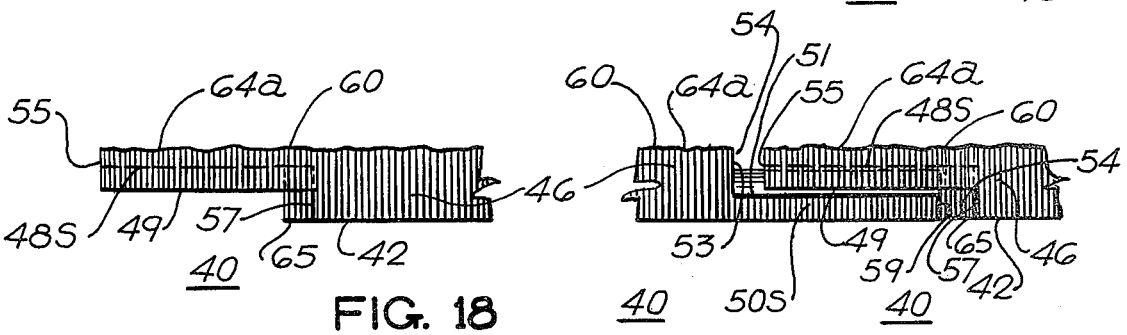
FIG. 18 is a lower edge elevational view of the panels looking in the direction of arrows 18—18 of FIG. 17 with the portion on the left illustrating a righthand panel by itself and the portion on the right illustrating a pair of panels laid up in end to end relation with an expansion space formed at a joint between the panels as provided by the spacer on the left hand panel.
Figure 19:
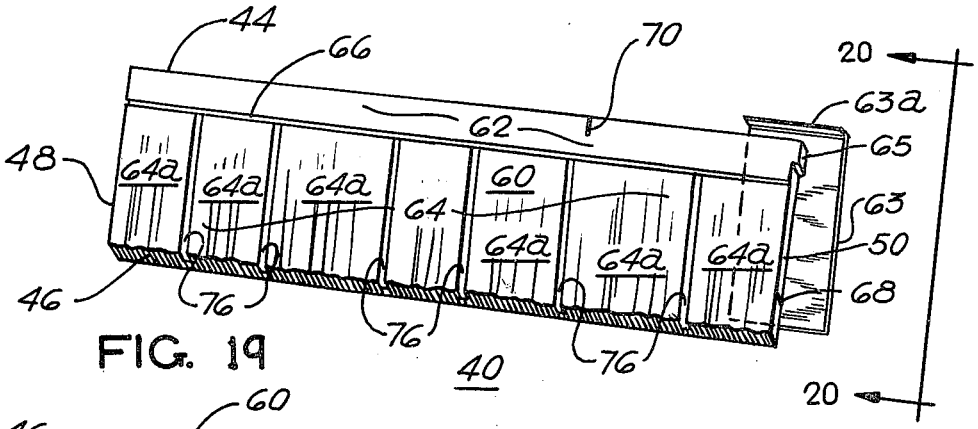
FIG. 19 is a perspective view of yet still another embodiment of a building panel constructed in accordance with the present invention in combination with a flashing element used in conjunction therewith, again illustrating an outer or weather surface of the panel and a lower butt edge.
Figure 20:
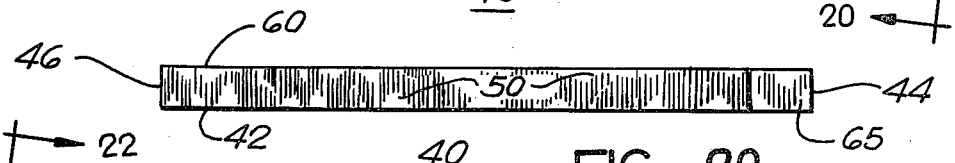
FIG. 20 is an end elevational view of the panel absent the flashing element looking in the direction of arrows 20—20 of FIG. 19.
Figure 21:
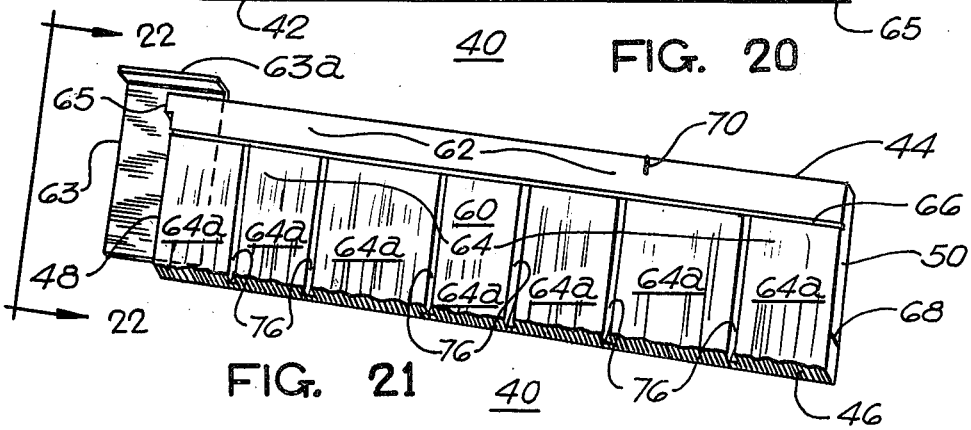
FIG. 21 is a perspective view of still another embodiment of a building panel constructed in accordance with the present in combination with and a flashing element used in conjunction therewith, again illustrating an outer or weather surface of the panel and a lower butt edge.
Figure 22:
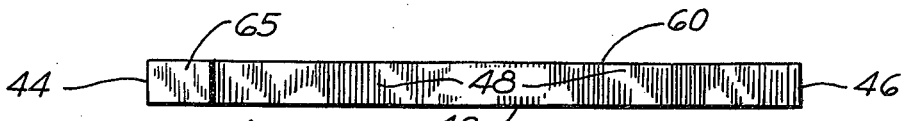
FIG. 22 is an end elevational view of the panel of FIG. 21 absent the flashing element looking in the direction of arrows 22—22.

In the building panel 40 of FIGS. 3–6 the spacer or projection 65 is positioned adjacent the upper end of the inner end face 53 associated with the righthand end of the panel as shown and when the panels are laid up end to end as shown in the righthand portion of FIG. 6, a space 54 is also established between the lower confronting end surfaces 57 and 59. The panel 40 of FIG. 7 includes a spacer 65 positioned adjacent the upper end of the outer end face 59 and as shown in the righthand portion of FIG. 10, when the panels are laid up end to end in a single course or row, a space 54 is formed between the lower end faces 57 and 59. The spacer 65 on the panel 40 of FIG. 11 is positioned at the lefthand end at the upper end of the outer end surface 55 of the overlapping end segment 48S. This spacer 65 again ensures that a desired expansion space 54 is provided between the end faces 53 and 55 of adjacent panels and on the underside of the end segment 48S, a similar space 54 is established between the lower end faces 57 and 59. The panel 40 of FIG. 15 includes an end spacer or projection 65 positioned adjacent the upper end of the inner end face 57 at the lefthand end portion of the panel and the spacer again ensures that a gap or space 54 is established between the end surfaces 53 and 55 and between the confronting lower end surfaces 57 and 59 of adjacent panels.

Figure 23:
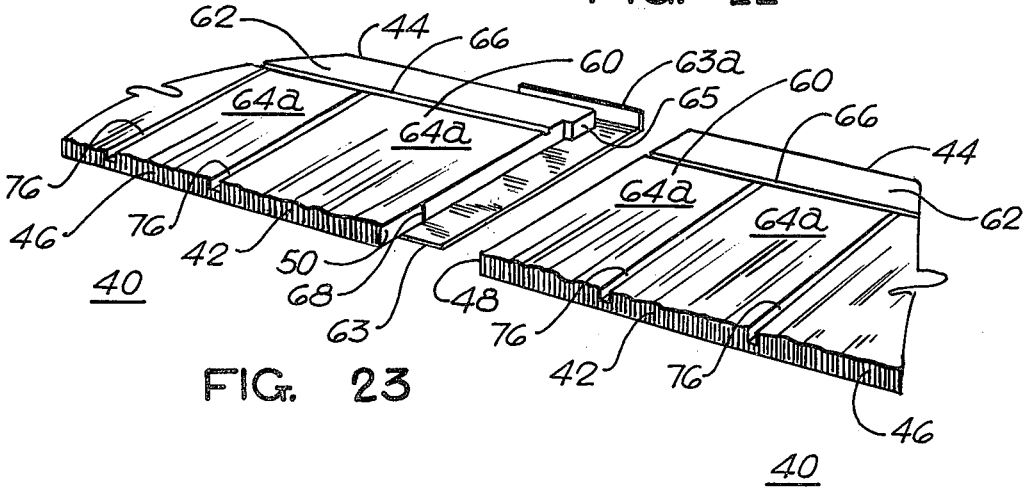
FIG. 23 is a fragmentary elevational view in perspective, illustrating a joint between a pair of panels of the type shown in FIG. 19 in pre-position prior to being laid up in end to end relation in a common course or row.

Referring now to FIGS. 19–23, the building panels 40 therein illustrated are provided with generally flat, substantially planar left and right hand end surfaces 48 and 50, respectively, which are normal to the upper and lower edges 44 and 46 and generally perpendicular with respect to the back face 42 and outer face 60. Joints between adjacent ends of panels in the same row or course are flashed with sheet metal flashing elements 63 having upstanding flanges **63*a* at the upper end and these flashing elements are adapted to form a water channel bottom for a groove or space 54 that is formed between adjacent ends of the panels by spacers 65 which may be positioned at the righthand end surface 50 in the panel of FIG. 19 or the lefthand end of the surface 48 of the panel of FIG. 21. When the panels are laid up in end to end relation as shown in FIG. 23 with the flashing element 63 in place, the spacer 65 provides a gap or space between the adjacent end surfaces 50 and 48 which is approximately equal in width to the width of the grooves 76 in the body of the panels. The joint or space 54 between pairs of panels is closely similar in appearance and difficult to visually distinguish from the groove 76 on the panel surface between shingle elements 64*a***.

As illustrated in FIG. 24, a roof or building wall structure is surfaced with the building panels 40 by applying a first course along a lower edge or eave with a left hand end 48/48S extended outwardly beyond a "saw line" which in turn is spaced outwardly of a rake edge of the building. Successive panels in the first course are then laid end to end along the row. A second course is started with the left hand end 48/48S of a first panel in the course extended outwardly to the left even beyond the left hand end of the end panel in the first course. Similarly, the left end panel in the third course extends outwardly to the left farther than the starter panel of the second course. Eventually these outwardly projecting panel end portions are cut of along the "saw line". The cut off portions may sometimes be utilized at the opposite (right hand) end of the course or on other parts of the structure depending upon the lengths thereof and distance coverage required. The application process as described may also be initiated from a right hand corner along the lower edge or eave and the panels may be aligned end to end in each course or row from right to left proceeding to the lefthand rake edge of the building or roof structure.

As illustrated, the course alignment marks 68 of panels 40 in the second course are positioned over the upper edges 44 of the panels in the first course and this aids a roofer in establishing precise parallel alignment of the lower or butt edges 46 of the panels in each succeeding course. The butt edge of panels in the second course are also visually aligned with the shallow grooves or nail marker lines 66 in the panels of first course to further insure that each succeeding course is precisely parallel to the last. The lines 66 and end marks 68 thus function cooperatively to aid an installer in easily establishing the precise and proper, but minimal amount of headlap or overlap between the panels as they are installed in each succeeding course or row.

In applying the panels 40 to a roof or wall surface it is recommended that the panels be installed over a minimum base of ½ inch thick CDX plywood or equivalent sheathing or decking. The sheathing or decking should also be covered with a layer of 15 pound asphalt felt or similar material prior to installation of the panels thereon. Nails or staples 72 are used to secure the panels in place and these fasteners are driven above the nailing line or groove 66 in the narrow, head lap or strip area 62, so as not to be exposed to the weather. Generally, galvanized roofing nails or staples are recommended, and normally five or six spaced apart fasteners are used to hold a 48" long building panel in place.

In practice, panels having a nominal length of 48 inches are easily handled by one person alone. Along the lower edge of a building wall or the eave of roof structure, a narrow starter strip 74 is utilized for the first course and a lower edge of the starter strip is spaced a short distance upwardly above the lower or thick butt edge 46 of the panels 40 of the starter course as illustrated in FIG. 2.

In a typical commercial embodiment of the present invention, panels 40 are dimensioned to be approximately 47 and 3/16th inches in length and 11 and 13/16th inches in width with a 3 inch wide head lap being provided between the upper edge 44 and the nail guide grooved line 66. The panels are nominally 7/16th inches thick and are packaged with 6 panels per bundle. In this size, only 6 bundles are required to cover 100 square feet or one "square" of a building roof or wall structure. Panels 40 having these size parameters produce a weight of approximately 240 pounds per "square" of surface area covered. This weight is comparable to that of many asphalt shingles but the panels 40 provide a great advantage in terms of the small number of pieces (36) necessary for covering a "square" of surface area. The panels 40 are recommended for use on roof slopes of 4 in 12 or steeper and are economical for use in new construction as well as for re-siding or re-roofing application over old materials already in place.

The spacers 65 on the panel ends provide for automatic precise joints or expansion spaces 54 and facilitate installation of the panels. The amount of lateral extension of the spacers 65 determines the width of the joints which is substantially equal to the width of the grooves 76 so as to appear all but indistinguishable therefrom. The expansion spaces 54 between adjacent panel ends effectively reduce the possibility of warping or buckling due to exposure to weather after installation of the panels 40.

Although the present invention has been described with reference to several illustrated embodiments thereof, it should be understood that numerous other modifications and embodiments can be made by those skilled in the art that will fall within the spirit and scope of the principles of this invention.

What is claimed as new and is desired to be secured by Letters Patent is:

1. A unitary building panel formed of composite wood fibrous material having generally parallel, inner and outer faces outlined by opposite ends and by upper and lower edges, said opposite ends of said panel adapted to closely face the end of an adjacent panel in the same course, said outer face having a large lower portion adapted for exposure to the weather with a substantially greater surface area than a narrow upper surface portion having a relatively smaller, substantially planar, surface area adapted to underlie a generally planar lower portion of the inner face of one or more of said panels laid up in a next higher course, said lower surface area of said outer face being deeply embossed to resemble a plurality of shingle-like elements laid up in a common course with each of said shingle like elements separated from an adjacent element by a groove tapered from a shallow depth adjacent an upper end adjacent said narrow upper surface portion toward a maximum depth opening into said lower edge of said panel, one of said opposite ends having a laterally outwardly projecting integral spacer adjacent an end of said smaller narrow upper surface portion extending laterally outwardly from said one of said opposite ends to provide an expansion space of a width generally similar to the width of said grooves between a lower portion of said one end and an adjacent end of an adjacent panel positioned in the same course.

2. The building panel of claim 1 wherein a lower edge of said integral spacer is positioned above said lower portion of said outer face.

3. The building panel of calim 1 wherein the end of said panel opposite said one end is generally flat and a lower portion of said opposite end below said spacer is substantially flat.

4. The building panel of claim 1 wherein said opposite ends of said panel are adapted to provide overlapping ship-lap joints with adjacent ends of adjacent panels laid end to end in the same course, one of said opposite ends comprising an overlapping segment extending between upper and lower edges of said panel and the other of said opposite ends comprising an underlying segment extending between said upper and lower edges of said panel, said overlapping segment adapted to overlap an underlying segment of a said panel and the other of said opposite ends comprising an underlying segment extending between said upper and lower edges of said panel, said overlapping segment adapted to overlap an underlying segment of a next adjacent panel in the same course to form a ship-lap joint, said overlapping segment having a thickness defined between said outer face end an underside that tapers from a minimum value at said upper edge of said panel to a maximum value at said lower edge of said panel, and said underlying segment having a thickness defined between an upper face thereof and said inner face of said panel tapering from a maximum value at said upper edge of said panel to a minimum value at said lower edge of said panel.

5. The building panel of claim 4 wherein said overlapping segment includes a pair of inner and outer end faces and an underside extending therebetween normal thereto, said underlying segment including a pair of inner and outer end faces and an upper side extending therebetween normal thereto, said underside of one panel adapted to confront and closely overlying said upper side of an adjacent panel laid in end to end relation in the same course.

6. The building panel of claim 5 wherein said spacer is positioned to extend outwardly of said inner end face of said underlying segment for contact against said outer end face of said overlapping segment of an adjacent panel in the same course to form said expansion space between ends of said panels.

7. The building panel of claim 5 wherein said spacer is positioned to extend outwardly of said outer end face of said underlying segment for contact against said inner end face of said overlapping segment of an adjacent panel in the same course to form said expansion space between ends of said panels.

8. The building panel of claim 5 wherein said spacer is positioned to extend outwardly of said outer end face of said overlapping segment for contact against said inner end face of said underlying segment of an adjacent panel in the same course to form said expansion space between ends of said panels.

9. The building panel of claim 5 wherein said spacer is positioned to extend outwardly of said inner end face of said overlapping segment for contact against said outer end face of said underlying segment of an adjacent panel in the same course to form said expansion space between ends of said panels.

10. The building panel of claim 4 including a course alignment mark positioned on said underlying segment adapted to overlie an upper edge of a panel in a next lower course.

11. The building panel of claim 5 including a course alignment mark positioned on said upper side of said underlying segment.

* * * * *